US006373354B2

(12) United States Patent
Schallner et al.

(10) Patent No.: US 6,373,354 B2
(45) **Date of Patent: *Apr. 16, 2002**

(54) METHOD OF ADJUSTING A RESONANCE FREQUENCY OF A RING RESONATOR

(75) Inventors: Martin Schallner, Ludwigsburg; Willibald Konrath, Weissach, both of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/306,620

(22) Filed: May 4, 1999

(30) Foreign Application Priority Data

May 13, 1998 (DE) ..... 198 21 382

(51) Int. Cl.[7] ..... H01P 7/00; H01P 3/08
(52) U.S. Cl. ..... 333/235; 333/219; 333/246
(58) Field of Search ..... 333/202, 204, 333/205, 219, 235, 246

(56) References Cited

U.S. PATENT DOCUMENTS

| | | | | | |
|---|---|---|---|---|---|
| 4,072,902 | A | * | 2/1978 | Knox et al. | 333/21 R |
| 4,157,517 | A | * | 6/1979 | Kneisel et al. | 333/205 |
| 4,619,001 | A | | 10/1986 | Kane | |
| 4,749,963 | A | * | 6/1988 | Makimoto et al. | 333/246 |
| 5,659,274 | A | * | 8/1997 | Takahashi et al. | 333/204 |
| 5,703,546 | A | * | 12/1997 | Takahashi et al. | 333/204 |
| 5,880,656 | A | * | 3/1999 | Yabuki et al. | 333/219 |

FOREIGN PATENT DOCUMENTS

| | | |
|---|---|---|
| DE | 21 18 309 A | 10/1972 |
| DE | 24 48 544 C2 | 12/1982 |
| DE | 44 36 295 A1 | 2/1996 |
| WO | 97 44852 A | 11/1997 |

OTHER PUBLICATIONS

Patent Abstracts If Japan, vol. 7, No. 200 (E–196), 1345, Sep. 3, 1983 & JP 58 099002 A, Jun. 13, 1983.

Patent Abstracts of Japan vol. 18, No. 213 (E–15538), Apr. 15, 1994 & JP 06 013807 A, Jan. 21, 1994.

Karacaoglu, et al: "An Improved Dual–Mode Microstrip Ring Resonator Filter with Simple Geometry", 24–th European Microwave Conference, 1994, S. 442–447.

Yabuki, H., et al: Stripline Dual–Mode Ring Resonators and Their Application to Microwave Devices, IEEE Transactions On Microwave Theory and Techniques, vol. 44, No. 5, May 1996, pp. 723–729.

Knoppik, N.: "Vergleich Und Guetigkeit Verschiedener Berechnungsverfahren Der Resonanzfrequenzen . . .", Nachrichtentechnische Zeitschrift, 1976, pp. 141–147.

Lu, S., Ferendeci, A.: Coupling Parameters for a Side-Coupled Ring Resonator and a Microstrip Line, IEEE Transactions on Microwave Theory and Techniques, vol. 44, No. 6, Jun. 1996, pp. 953–956.

Kickelhain, J.: Lasertechnik in Der Leiterplattenfertigung, Metalloberflaeche, 1991, Heft 8, pp. 349–358.

Kickelhain, J.: Mikrostrukturierung Mittels Lasertechnik, SMD–Magazin, 1990, H. 3/4, p. 38–40.

Patent Abstract of Japan E–1572, 1994, vol. 18, No. 350 JP 6–90105 A.

(List continued on next page.)

*Primary Examiner*—Robert Pascal
*Assistant Examiner*—Patricia T. Nguyen
(74) *Attorney, Agent, or Firm*—Michael J. Striker

(57) ABSTRACT

The method for adjusting a resonance frequency of a ring resonator formed as a strip line ring exactly includes removing successive amounts of conducting material from one or more positions (2,3) on the strip line ring (1) with a laser until the ring resonator has a desired predetermined resonance frequency.

10 Claims, 1 Drawing Sheet

OTHER PUBLICATIONS

"Stripline Dual–Mode Ring Resonators and Their Application to Microwave Devices"By Hiroyuki Yabuki, Morikazu Sagawa, IEEE Transactions on Microwave Theory and Technique, vol. 44, No. 5, May 1996, pp. 723–729.

"An Improved Dual–Mode Microstrip Ring Resonator Filter with Simple Geometry" By U. Karacaoglu, I.D. Robertson, M. Guglielmi, 24–th European Microwave Conference, 1994, pp. 472–276.

Karacaoglu, U.: An Improved Dual–Mode Microstrip . . . , In: 24–th European Microwave Conference, 1994, S. 442–447.

Yabuki, H.: Stripline Dual–Mode Resonators and Their Application . . ., In: IEEE Transactions On Microwave Theory and Techniques, vol. 44, No. 5, May 1996, S. 723–729.

* cited by examiner-

METHOD OF ADJUSTING A RESONANCE FREQUENCY OF A RING RESONATOR

BACKGROUND OF THE INVENTION

1. Field of the Invention

The present invention relates to a method of adjusting a ring resonator and, more particularly, to a method of exactly adjusting the resonance frequency of the ring resonator.

2. Prior Art

Ring resonators, for example for narrow band filters and for constructing resonators for microwave oscillators, formed as strip lines, are known, for example, from the article by U. Karacaoglu, I. D. Robertson and M. Guglielmi, entitled "An Improved Dual-Mode Microstrip Ring Resonator Filter with Simple Geometry", 24th European "Microwave Conference", 1994, pp. 442 to 447, and the article by H. Yabuki, M. Sagawa, M. Matsuo and M. Makimoto, entitled "Stripline Dual-Mode Ring Resonators and Their Application to Microwave Devices", IEEE Transactions on Microwave Theory and Techniques, Vol. 44, No. 5, May 1996, pp. 723 to 729. For those applications the desired resonance frequency at which the ring resonator should oscillate to filter a narrow frequency band must be adjusted very accurately. These printed ring resonators usually have material variations and manufacturing tolerances, especially at higher frequencies, since the manufacturing tolerances produce greater effects because of the smaller dimensions of the ring resonator. A printed ring resonator thus usually has a resonance frequency which is not exactly equal to the predetermined desired resonance frequency. An adjustment of the resonance frequency must occur subsequently in which the Q or quality factor of the resonator may be impaired only insignificantly. It is very important for the electrical properties of the oscillator and/or filter that the Q of the resonator be kept as high as possible.

SUMMARY OF THE INVENTION

It is an object of the present invention to provide a method for very accurate adjustment of a resonance frequency of a ring resonator which is formed as a strip line ring, which is as simple and easy to perform as possible.

These objects, and others which will be made more apparent hereinafter, have been attained in a method for adjusting a resonance frequency of a ring resonator, which is formed as a strip line ring.

According to the invention, conducting material is removed with a laser at one or more positions on the strip line ring or a strip line coupled to this strip line ring, until a desired predetermined resonance frequency is reached. This method attains the above object of the invention.

A very accurate adjustment of the resonance frequency of ring resonators formed in strip line engineering may be performed using the method according to the invention, since the conductive material can be removed in arbitrarily small portions by means of a laser. Because of these adjusting processes it is possible to allow greater manufacturing tolerances and fluctuations in material parameters, whereby a considerable cost reduction is attained. The geometric structure of the resonator is only changed slightly by the laser adjustment so that the resonance quality is only slightly reduced. For use in oscillators and filters as high as possible a quality factor is required.

According to preferred embodiments of the invention conducting material is removed at positions on the strip line ring at which current maxima occur in order to reduce the resonance frequency, or at positions at which current minima occur in order to increase the resonance frequency.

In various preferred embodiments the conducting material is appropriately removed in the form of a slot narrowing or reducing the conductor width of the strip line ring. A gross adjustment of the resonance frequency can be obtained by varying the depth of the slot. A fine adjustment of the resonance frequency occurs by changing the width of the slot. In the strip line coupled with the strip line ring either material is removed to shorten its length or to reduce its width at one or more positions.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
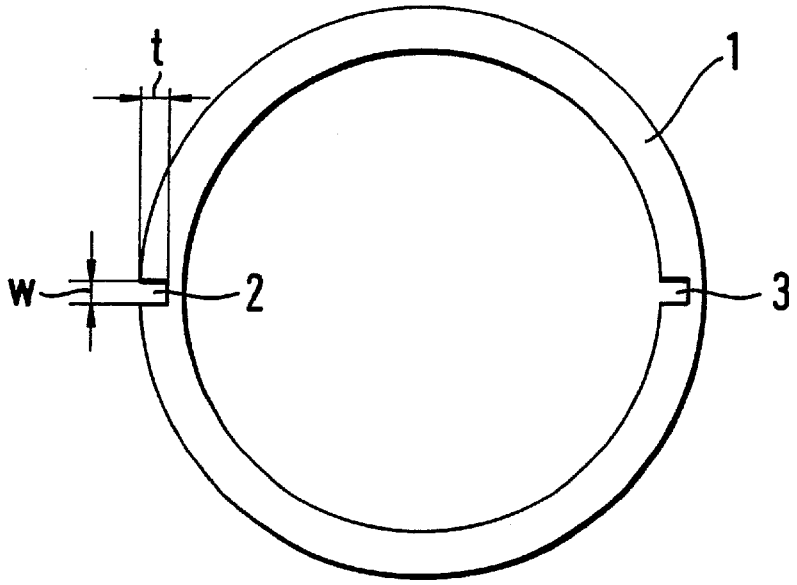
FIG. 1 is a diagrammatic plan view of a ring resonator formed as a strip line ring.

A strip line ring 1 of a ring resonator is shown in FIG. 1. In this embodiment the strip line ring is made of gold. A slot 2 is provided in an outside edge of this strip line ring 1 by removing material by means of a pulsed YAG laser in order to tune the resonance frequency of this ring resonator. Other types of lasers may also be used. The narrowing or reduction of conductor width caused by this slot 2 acts like an addition of an inductance in series in the resonance circuit. The depth t of the slot 2 made using the laser has a greater influence on the resonance frequency than the width w of the slot 2. Thus a coarse adjustment is performed by changing the depth t of the slot 2 and a fine adjustment is performed by changing the width w of the slot 2. While the slot 2 is introduced on the outer side of the strip line ring 1, also a slot 3 can be provided on the inner side of the strip line ring 1.

In other embodiments of the invention several slots may be provided in the inner edge and/or outer edge of the strip line ring 1. When the slots are placed at positions where current maxima occur, the resonance frequency is thus reduced. If instead one selects the places where current minima occur in the strip line ring 1, that leads to an increase in the resonance frequency.

In order to adjust the resonance frequency of the ring resonator, the material removal to change the strip line geometry can also take other forms than laterally introduced slots 2,3, For example certain surface or area elements can be removed from the inside of the strip line ring 1.

Figure 2:
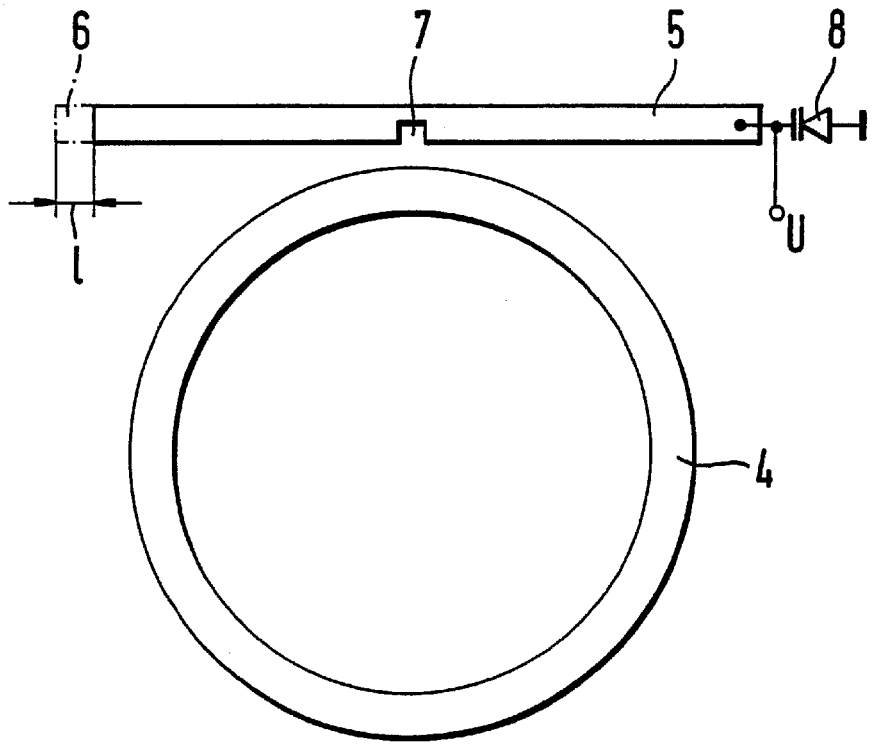
FIG. 2 is a diagrammatic plan view of a ring resonator formed as a strip line ring coupled with a strip line.

As shown in FIG. 2, the adjustment of the resonance frequency of a ring resonator occurs by changing the length or width at one or more locations on a strip line 5 coupled with the strip line ring 4 by removing material with a laser. In the embodiment shown in FIG. 2 the strip line 5 is shortened by removing a piece 6 of length 1 and/or by a slot 7 in the coupling region adjacent the strip line ring 4.

Also material can be removed at one or more locations on the strip line ring 4 in addition to the coupled strip line 5, in order to adjust the resonance frequency of the ring resonator.

The removal of conductive material in the strip line ring 1, 4 and/or on the strip line 5 occurs during a measuring process in which the resonance frequency is measured. Thus the effect on the resonance frequency of removing a certain amount of material can be directly observed and thus the removal can proceed until the exact predetermined desired resonance frequency has been reached.

If, as shown in FIG. 2, a varactor (capacitive) diode 8 is connected to the strip line 5, the resonator can be detuned or adjusted off resonance by means of a control voltage U electronically. The tuning rate of rise can be made constant by a material removal, e.g. at the positions 6 and 7 on the strip line 5.

During the removal of material from the strip line ring the aperture of the laser beam must be much smaller than the width of the strip line 5 or strip line ring 1 in order to provide sufficient tuning accuracy. Typically the width of the strip line or strip line ring is, e.g., from 50 $\mu$m to 1000 $\mu$m, while the aperture of the laser beam should be e.g. from 10 $\mu$m×10 $\mu$m to 60 $\mu$m×60 $\mu$m. Furthermore the precision of the positioning of the laser beam should be much smaller than the aperture of the laser beam in order to tune with sufficient accuracy. It should be possible to position the laser beam to an accuracy of e.g. from 1 $\mu$m to 2 $\mu$m. An accuracy of the trimmed resonance frequency of, for example, 4 ppm can be obtained.

The disclosure in German Patent Application 198 21 382.4–34 of May 13, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a method of adjusting a resonance frequency of a ring resonator, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A method for adjusting a resonance frequency of a ring resonator formed as a strip line ring (1), said method including removing successive amounts of conducting material from one or more positions on the strip line ring (1) with a laser until the ring resonator has a desired predetermined resonance frequency.

2. The method as defined in claim 1, wherein current maxima occur at said one or more positions on the strip line ring (1), whereby said resonance frequency is reduced when said conducting material is removed.

3. The method as defined in claim 1, wherein current minima occur at said one or more positions on the strip line ring (1), whereby said resonance frequency is increased when said conducting material is removed.

4. The method as defined in claim 1, wherein said conducting material removed by said laser forms at least one slot (2,3) narrowing or reducing a conductor width of said strip line ring (1).

5. The method as defined in claim 4, wherein said laser is controlled to vary a depth (t) of said at least one slot (2), whereby a coarse adjustment of said resonance frequency is attained.

6. The method as defined in claim 4, whereby said laser is controlled to vary a slot width (w) of said at least one slot (2), whereby a fine adjustment of said resonance frequency is attained.

7. A method for adjusting a resonance frequency of a ring resonator formed as a strip line ring (1), said method including removing successive amounts of conducting material from one or more positions (6,7) on a strip line (5) coupled to the strip line ring (1) with a laser until the ring resonator has a desired predetermined resonance frequency.

8. The method as defined in claim 7, wherein said conducting material is removed from the strip line (5) in order to shorten said strip line (5) or reduce a conductor width of said strip line (5) at said one or more positions (6,7).

9. The method as defined in claim 7, further comprising continuously measuring said resonance frequency during said removing of said successive amounts of said material with said laser.

10. The method as defined in claim 1, further comprising continuously measuring said resonance frequency during said removing of said successive amounts of said material with said laser.

* * * * *